US006402910B1

(12) United States Patent
Pütter et al.

(10) Patent No.: US 6,402,910 B1
(45) Date of Patent: Jun. 11, 2002

(54) ELECTROLYTIC CELL

(75) Inventors: Hermann Pütter, Neustadt; Günther Huber, Ludwigshafen-Ruchheim; Luise Spiske, Seeheim-Jugenheim; Hans Stark, Bobenheim-Roxheim; Dieter Schläfer; Gerhard Pforr, both of Ludwigshafen, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/567,210

(22) Filed: May 9, 2000

Related U.S. Application Data

(62) Division of application No. 09/000,276, filed as application No. PCT/EP96/03892 on Sep. 4, 1996, now Pat. No. 6,235, 183.

(30) Foreign Application Priority Data

Sep. 8, 1995 (DE) ..... 195 33 214

(51) Int. Cl.[7] ..... C25C 3/00
(52) U.S. Cl. ..... 204/245; 204/247
(58) Field of Search ..... 204/245–247; 205/359

(56) References Cited

U.S. PATENT DOCUMENTS 3,607,684 A * 9/1971 Kuhn ..... 204/247 X
4,846,943 A * 7/1989 Coetzer et al.

* cited by examiner

*Primary Examiner*—Donald R. Valentine
(74) *Attorney, Agent, or Firm*—Keil & Weinkauf

(57) ABSTRACT

A process for preparing sodium and aluminum chloride electrochemically is described in which, in an electrolytic cell containing aluminum as an anode and sodium as a cathode which are separated from one another by a sodium ion-conducting solid electrolyte, a fused electrolyte essentially containing sodium tetrachloroaluminate is electrolyzed in the anode compartment, aluminum chloride formed in this process is evaporated from the electrolytic cell and sodium is removed from the cathode compartment.

2 Claims, 1 Drawing Sheet

ELECTROLYTIC CELL

This application is a divisional of Ser. No. 09/000,276, filed on Jan. 17, 1998, now U.S. Pat. No. 6,235,183, which is a rule 371 or PCT EP96/03892, filed Sep. 4, 1996.

The present invention relates to a novel process for preparing sodium and aluminum chloride electrochemically.

The invention furthermore relates to an electrolytic cell suitable for carrying out this process and to a process for cleaning this cell.

Sodium is an important inorganic basic product which is used, for example, for preparing sodium amide and sodium alkoxides. It is obtained industrially by the Downs process by electrolysis of molten sodium chloride. This process has a high energy. consumption of over 10 kWh/kg of sodium (B üchner et al., Industrielle Anorganische Chemie [Industrial Inorganic Chemistry], 2nd Edition, Verlag Chemie, p. 228 ff). The process furthermore has the serious disadvantage that the electrolytic cells are destroyed by the solidification of the salt melt on turning them off.

Aluminum chloride is mainly employed as a catalyst, eg. in Friedel-Crafts reactions. Preparation is carried out to a great extent by direct chlorination of molten aluminum. (B üchner et al., Industrielle Anorganische Chemie, [Industrial Inorganic Chemistry], 2nd Edition, Verlag Chemie, p. 262). In this process, a substantial part of the energy which was used in the form of electric current for electrolytic preparation of chlorine and aluminum is liberated unused.

GB-A 2 056 757 describes a process for lowering the melting points of alkali metal tetrachloroaluminates by adding an alkali metal fluoride and the use of such mixtures as electrolyte.

DE-A 37 18 920 relates to the coupled electrochemical preparation of an alkali metal and an alkali metal halide compound such as sodium tetrachloroaluminate. The coupled product thus formed in addition to the alkali metal, however, is unattractive for production on the industrial scale. The formation of sodium tetrachloroaluminate from sodium chloride and aluminum chloride is automatically connected with the formation of aluminum chloride. According to the patent description, a concentration of aluminum chloride should be avoided in order to avoid damage to the separator between the anode and cathode compartments and a rise in the cell voltage.

It is an object of the present invention to provide a process which allows an energetically more favourable preparation of sodium than the Downs process. The coupled product obtained in the process should be a substance which can be employed on the industrial scale. Both process products should be obtained in such a high purity that further expensive purification steps are not necessary. A further aspect of the object consists in finding a process which allows the electrolysis process to be carried out repeatedly in the same electrolytic cell. Additionally, it was part of the object to find an electrolytic cell suitable for this process. Furthermore, a process for cleaning the electrolytic cell used for the reaction was to be found.

We have found that this object is achieved by a process for preparing sodium and aluminum chloride electrochemically, which comprises, in an electrolytic cell having aluminum as an anode and sodium as a cathode which are separated from one another by a sodium ion-conducting solid electrolyte, electrolyzing a fused electrolyte consisting essentially of sodium tetrachloroaluminate in the anode compartment, evaporating aluminum chloride formed in this process from the electrolytic cell and removing sodium from the cathode compartment.

BRIEF DESCRIPTION OF THE DRAWING

An electrolytic cell described in greater detail below was additionally found, in which the process according to the invention can be operated.

A process for cleaning an electrolytic cell suitable for the process described by aerating the electrolyte with $SO_2$ was furthermore found.

Figure 1:
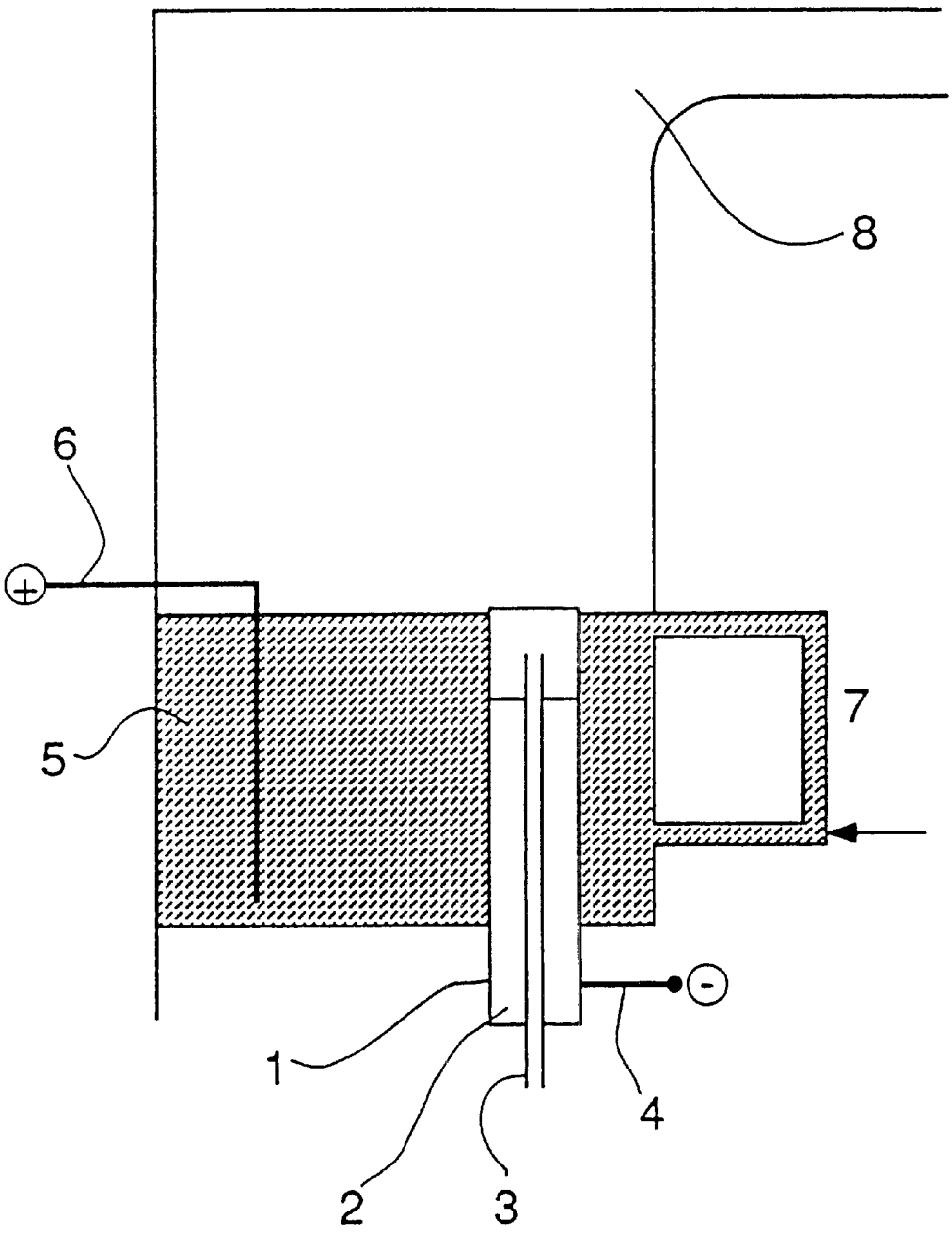

The process according to the invention is operated in an electrolytic cell having an aluminum anode. This is a sacrificial anode which dissolves during the reaction so that on continuous operation aluminum has to be added. Aluminum can be added in the form of sheets, but preferably in the form of small metal pieces, which arrange themselves with large intermediate spaces between the individual pieces during filling, such as turnings, shot or shredded parts. In general, the particle size can be from 0.01 to 10 mm, preferably from 0.1 to 2 mm. Commercially available aluminum having a purity of about 99.3% or aluminum shot having a purity of 95% is suitable. The current supply on the anode side preferably takes place by means of aluminum rods, which on continuous operation of the cell can be replaced from outside without interrupting the process.

The cathode consists of sodium, which is present in liquid form at the temperatures which are necessary for liquefying the electrolyte. At the start of the electrolysis, the sodium is advantageously brought into the cathode compartment in liquid form. The sodium formed in the process according to the invention can be removed from the cathode compartment in a technically simple manner by means of an overflow. The cathodic current supply can take place, for example, by means of aluminum rods.

The anode compartment and the cathode compartment are separated from one another by a sodium ion-conducting solid electrolyte. Suitable materials for this purpose are ceramic materials such as NASICON®, whose composition is given in EP-A 553 400. Sodium ion-conducting glasses are also suitable as well as zeolites and feldspars. β"-Alumina, however, is preferred.

The electrolyte for starting the reaction is preferably prepared by melting stoichiometric amounts of sodium chloride and aluminum chloride. During the reaction, the amount of electrolyte does not change on continuous operation. During the reaction, aluminum chloride is evaporated from the anode compartment. The anode compartment is therefore connected above the electrolyte surface to a drainage line, eg. in the form of a pipe, through which the aluminum chloride can escape. A reservoir is advantageously attached to the drainage line device, in which, by lowering the temperature compared with the electrolytic cell, desublimation of the aluminum chloride takes place. This generally deposits as a wall covering which can be removed by mechanical methods.

For continuous operation of the electrolysis, aluminum as sacrificial anode as well as sodium chloride have to be subsequently added according to the sodium and aluminum chloride discharged. Sodium chloride is preferably added as a solid to the anode compartment as common salt having a purity of 99.9%. In general, the reaction temperature is from the liquefaction temperature of the electrolyte as a lower limit (about 150° C.) to 400° C., preferably from 250 to 350° C. In general, the electrical potential is from 2 to 5 V, the cathodic current density from 1 to 10 $kA/m^2$.

During the reaction the electrolyte can be recirculated. This can be carried out by means of a pump, but blowing in an inert gas such as argon is preferred. This feeding-in of gas assists the evaporation of the aluminum chloride from the anode compartment.

In a preferred embodiment of the electrolytic cell, the cell, which can be heated from outside, is constructed similarly to a shell-and-tube recirculation evaporator (see FIG. 1), ie. a cylinder closed at the top, of β"-alumina 1, which is filled with sodium 2, contains an overflow 3, and is connected as cathode via an aluminum rod 4 to a voltage source, and projects into the anode compartment 5 which is provided with solid aluminum parts and a liquid electrolyte essentially containing sodium tetrachloroaluminate. The anode is attached to a voltage source via an aluminum rod 6. A recirculation tube 7, into which inert gas is blown, is used for recirculating the electrolyte. Aluminum chloride is discharged via the drainage line 8. For industrial production, several of these cells can be connected in parallel or a large anode compartment can be provided with several cathodes, it being possible for the cathode to project into the anode compartment both from above and from below. The appliances for adding sodium chloride and preferably aluminum shot are advantageously arranged so that the solids fall directly into the electrolyte, ie. they are preferably arranged directly above the anode compartment.

By means of the starting compounds aluminum and sodium chloride, foreign substances such as iron, silicon and potassium, which can concentrate in the electrolyte, are introduced into the electrolytic cell. These can be reduced by electrolyzing part streams of the electrolyte, for example from 1 to 10% by weight, based on the total amount of electrolyte, in the side stream. An anodic electrolysis on graphite electrodes thus reduces the oxide content of the melt. Iron and also, if appropriate, other heavy metals present in the liquid electrolyte can be deposited on iron cathodes.

On turning off the electrolysis, the problematic handling of the solidified electrolyte melt containing residues of metallic sodium can become unnecessary if during cooling the melt is aerated with $SO_2$. The melt remains pasty from 150 to about 70° C. with absorption of $SO_2$, and at lower temperatures it becomes liquid. It can thus be drawn off from the cell without problems, which simplifies matters greatly in the case of repair. The liquid, $SO_2$-containing melt can be filtered, which is advantageous, in particular, for removing potassium compounds. The liquid $SO_2$-containing melt can then be refilled into the electrolytic cell, where the $SO_2$ can be driven off while heating to about 165° C. in the presence of an excess of sodium chloride.

By periodically reversing the polarity of the cells, the solid electrolyte can be purified of cationic impurities such as potassium ions.

The electrochemical process according to the invention for the coupled production of sodium and aluminum chloride needs only about 50% of the amount of energy which is necessary for the preparation of sodium by the Downs process. The operating temperatures are distinctly below those of the named process (about 650° C.), which considerably simplifies the selection and use of the reaction cells. The turning-off of the electrolytic cells is possible without damage.

The products obtained according to the invention are highly pure. In contrast to the usual commercially available products, aluminum chloride is obtained in colorless form, which makes it particularly attractive for applications in which the color of the final product is an important feature. At a current efficiency of over 90%, the sodium yield is virtually quantitative and the yield of aluminum chloride is distinctly above 90%.

It was not possible to find damage to the solid electrolyte even after long-term tests.

In principle, the process can also be used for the preparation of sodium and other metal halides which are volatile under the reaction conditions, eg. $SiCl_4$, $GeCl_4$, $TiCl_4$. For this, the anode and electrolyte must each contain the corresponding metal.

EXAMPLE 1

Apparatus

The electrolytic cell according to FIG. 1 employed for carrying out the process consisted of a vertical tube (having an internal diameter of 50 mm and a length of 400 mm) of borosilicate glass, into which the anode current supply was tightly clamped in the form of a hollow cylinder of aluminum. The sodium ion-conducting solid electrolyte of β"-alumina (25 mm outer diameter, 210 mm length) was flanged in at the lower end together with the cathode current supply. The upper part of the tube was provided with nozzles, which were used for filling with electrolyte, aluminum and sodium chloride and for leading off the $AlCl_3$ vapours. The cell was heated using hot air. The anode was inserted in the form of a packing of aluminum shreds. Liquid sodium was used as the cathode, and was introduced at the start of the reaction. The sodium formed in the reaction ran off downwards as unobstructed overflow. The $AlCl_3$ vapours were condensed in an air-cooled desublimator. The externally attached circulation with inert gas supply was used for recirculating the melt.

Before putting into operation, the electrolytic cell was heated to 280° C. 85 g of sodium were melted at 150° C. in the melting vessel and added to the cathode compartment until this was filled to overflowing. 485 g of $AlCl_3$ and 215 g of NaCl were introduced as solid and stirred under argon. After heating to 165° C., the mixture formed a homogeneous liquid phase, which was poured into the anode compartment. 150 g of aluminum were introduced into the anode compartment as shot having a grain size from 0.4 to 1.5 mm. The liquid electrolyte was kept in circulation by means of introduction of argon gas at the bottom of the circulation line. A current of 30 A was applied and the cell voltage was determined at 3.5 V. The current density based on the internal diameter of the solid electrolyte was 2200 $A/m^2$ with a surface area of 137 $cm^2$ (at 30 A). 15 minutes after switching on the current, the rising of $AlCl_3$ vapours which condensed in the desublimator was observed for the first time. At intervals of 15 minutes, 16,4 g of NaCl in each case was subsequently added as solid. The evolution of $AlCl_3$ ceased for a few minutes directly after the NaCl was added; at the same time a decrease in the cell voltage was observed. The cell voltage varied from 3.5 to 3.8 V in the interval between NaCl addition. At intervals of 30 minutes, the polarity of the electrolysis current was reversed for 90 seconds in each case. The liquid sodium ran off dropwise at regular time intervals and solidified in a receiver filled with liquid paraffin to give small spheres. The electrolyte assumed a dark-brown coloration after putting the electrolysis cell into operation.

Operating time: 5 h

Operating temperature: 280° C.

Charge employed: 150 Ah

Substances employed (total): 150 g of Al; 262 g of NaCl (without first filling the cell)

Experimental results:

| | |
|---|---|
| Products obtained (total): | 250 g of $AlCl_3$ in a purity of 99.2%<br>120 g of Na in a purity of 99.1% |
| Current efficiency for Na: | 92.4% |
| Current efficiency for $AlCl_3$: | 99.7% |
| Energy consumption for 1 kg of Na: | 4600 Wh/kg |

We claim:

1. An electrolytic cell for preparing sodium and aluminum chloride electrochemically, which has an anode compartment housing an aluminum anode, a cathode compartment housing a sodium cathode, a sodium ion-conducting solid electrolyte for separating the anode compartment and the cathode compartment, said compartments adapted to hold liquid electrolyte essentially comprising sodium tetrachloroaluminate, and an appliance for discharging gaseous aluminum chloride released during the electrolysis, which appliance is connected with the anode compartment at a position which, during operation of the cell, is above the electrolyte surface.

2. An electrolytic cell as claimed in claim 1, which has an appliance for adding sodium chloride to the electrolyte and aluminum shot to the anode.

* * * * *